United States Patent [19]

Griew

[11] Patent Number: 4,669,197

[45] Date of Patent: Jun. 2, 1987

[54] DRAWING AID

[76] Inventor: David C. L. Griew, 34 The Ridings, East Preston, Littlehampton, West Sussex, TN16 2TW, United Kingdom

[21] Appl. No.: 674,040

[22] PCT Filed: Mar. 26, 1984

[86] PCT No.: PCT/GB84/00096

§ 371 Date: Nov. 23, 1984

§ 102(e) Date: Nov. 23, 1984

[87] PCT Pub. No.: WO84/03863

PCT Pub. Date: Oct. 11, 1984

[51] Int. Cl.[4] ..... B43L 7/02

[52] U.S. Cl. ..... 33/403; 33/468; 33/479

[58] Field of Search ..... 33/403, 430, 433, 437, 33/468–470, 474, 479, 480, 484, 485, 489; D10/65

[56] References Cited

U.S. PATENT DOCUMENTS

| | | | |
|---|---|---|---|
| D. 137,749 | 4/1944 | Murphy | 33/470 |
| 1,614,812 | 1/1927 | Trane et al. | 33/485 |
| 1,802,217 | 3/1929 | Raine | 248/118.1 |
| 2,046,936 | 7/1936 | Castronovo | 33/474 |
| 2,883,754 | 4/1959 | Luebkeman | 33/476 |
| 2,923,061 | 2/1960 | Dolgorukov | 33/479 |

FOREIGN PATENT DOCUMENTS

| | | | |
|---|---|---|---|
| 117137 | 3/1900 | Fed. Rep. of Germany . | |
| 407604 | 12/1924 | Fed. Rep. of Germany | 33/484 |
| 846968 | 7/1949 | Fed. Rep. of Germany . | |
| 1160185 | 11/1956 | France . | |
| 88762 | 7/1921 | Switzerland . | |
| 569834 | 6/1945 | United Kingdom | 33/429 |

*Primary Examiner*—Charles Frankfort
*Assistant Examiner*—Patrick R. Scanlon
*Attorney, Agent, or Firm*—Barnes & Thornburg

[57] ABSTRACT

A drawing aid for assisting in the marking of lines or other markings on sheet material incorporates a blade-like portion (2) which is connected with a location region (1A, 2A) which includes means (4, 5) deformable relative to the blade-like portion to be able to provide abutment surfaces which enable the aid to so co-operate with the actual edge of a sheet (8) of flexible or non-rigid material such as a sheet of paper as to use the edge (11) as the guide for the aid during the positional adjustment thereof to the location at which it is desired to draw lines or the like on the sheet (8). When the aid is engaged with a sheet edge (11) a part (1A, 2A) of the aid (1) presses on the sheet marginal edge (11A) to remove any buckles etc. and also to prevent any relative displacement of aid and sheet.

12 Claims, 9 Drawing Figures

DRAWING AID

This invention relate to drawing aids.

In particular, the present invention is concerned with an arrangement for facilitating the drawing, marking or scribing of continous lines, series of dots or dashes or combinations thereof on a sheet of markable material in such manner that the lines etc., are aligned at a predetermined orientation with respect to a reference direction, such as the edge of the sheet.

In this specification the term markable material is intended to include paper, card, plastics, metal sheet or foil in extended area form and which is of such thickness or characteristic as to be flexible or nonrigid.

It is known to provide aids for drawing lines or series of dots, dashes etc., at a predetermined angle with respect to a reference direction.

One such aid, commonly called a Tee Square, includes a wooden or other rigid material elongate stock defining a reference face or edge along the length thereof and an elongate blade of which at least one of the longer edges thereof is intended to provide a straight edge or guide face for a writing or marking implement, this straight edge or guide face being conventionally perpendicular to the stock reference face or edge.

In use of the known Tee Square it is necessary for the stock reference edge to abut the side or end face of a raised platform such as a drawing board or drafting table upon which the sheet material to be marked has been previously secured in place.

In practice, the sheet of material is conventionally 'set' or oriented for the purposes of drawing thereupon by engaging the Tee Square stock with one of the end faces of the board or table and then causing the lower edge of the sheet of paper to abut the Tee Square blade guide edge thereby to ensure that the lower edge of the paper sheet is parallel to the Tee Square blade guide edge. Following this alignment, the paper is firmly secured i.e., pinned or taped to the board or table so as to prevent any subsequent movement. In using the Tee Square the latter is moved up or down whilst maintaining the stock against the board or table with respect to the paper sheet and lines etc., are drawn where required.

Since the Tee Square stock needs to have considerable depth or thickness for the purposes of structural strength and rigidity it is, in practice, necessary positively to secure the sheet material on a platform (i.e., board or table) which provides an accurately rectilinear reference edge of an adequate vertical depth for the effective use of the Tee Square. If this platform is not available it is not possible to use the Tee Square. Consequently, the use of a Tee Square or like drawing aid is wholly restricted to the availability of the support platform with the requisite accuracy in construction for receiving and guiding the The Tee Square stock edge. In other words the known Tee Square constructions cannot be regarded as being suitable as a portable drawing aid.

It is an object of the present invention to provide a drawing aid which avoids the above mentioned difficulties such as the need for a platform type of sheet support with an accurate guide edge.

According to the present invention there is provided a drawing aid incorporating at least one guide edge for co-operation with a material marking means, for facilitating the drawing of lines or other markings upon sheet material lying upon a support surface, characterised in that the drawing aid is adapted to utilise a marginal edge region of a sheet of material in such manner that the sheet edge is caused to provide a reference or direction guide for the drawing aid when operationally setting or positioning the aid with respect to the sheet.

Conveniently the adaptation is such that when the aid is in co-operation with the marginal edge region relative movement between the sheet and the aid and between the sheet and the support surface is simultaneously prevented.

In a preferred construction the aid incorporates an elongate blade portion defining said at least one guide edge and in addition the aid includes a location portion adapted for co-operation with an edge of the sheet to set the guide edge at a predetermined direction with respect to the edge of the sheet.

For a better understanding of the invention and to show how to carry the same into effect reference will now be made to the accompanying drawings in which.

Figure 1:
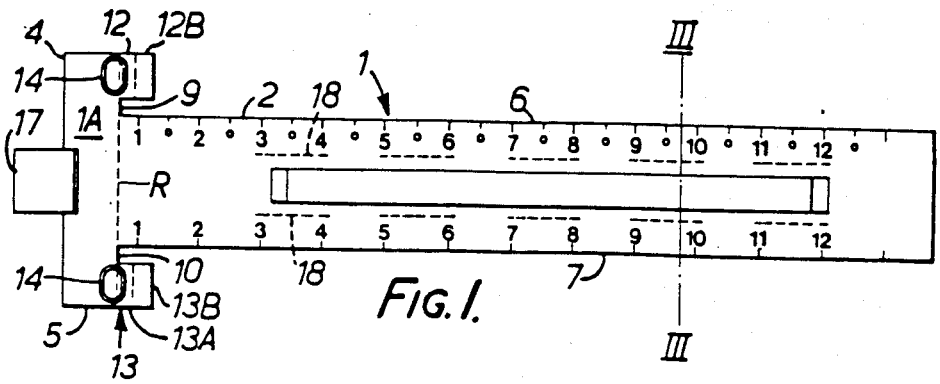
FIG. 1 is a diagrammatic plan view of a first embodiment of a drawing aid for facilitating the production of lines or the like running perpendicular to an edge of a sheet of material, i.e., a sheet of paper.
Figure 2:
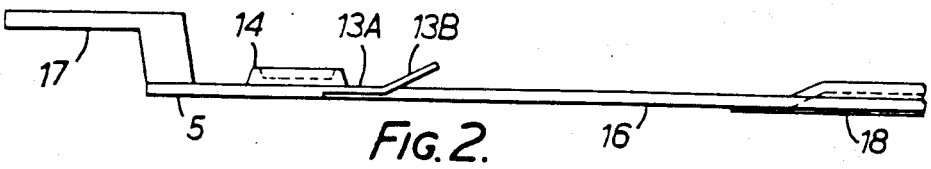
FIG. 2 is a diagrammatic side view to a larger scale of a part of the drawing aid of FIG. 1.
Figure 3:
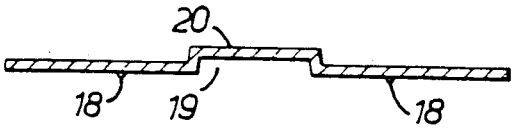
FIG. 3 is a section taken upon the line III—III of FIG. 1, the section being to a larger scale than that of FIG. 1.

Referring now to FIGS. 1, 2, 3 and 4 the drawing aid 1 shown therein includes a main body 2 of an elongate blade like rectangular shape having at one end thereof lugs, arms, ears or other elements 4 and 5 which extend in opposite directions from the main body and generally in a direction transverse to the length of the main body 2.

The longitudinal edges 6 and 7 of the main body 2 are parallel to each other, with each edge being intended to provide a guide edge for a marking implement, such as a pencil, pen, scriber or the like (not shown) which is to be used to produce the requisite markings, i.e., continuous lines, on a sheet of paper 8 (shown in FIG. 4) In addition, the edges 9 and 10 of the elements 4 and 5 are precisely in line with each other, and, in practice, effectively combine or co-operate to define a reference direction indicated by the dashed line R. This line R is accurately perpendicular to the direction of the guide edges 6 and 7.

To use the drawing aid as so far described a sheet 8 of paper having a straight edge 11 is placed upon a suitable support surface 8A of which only a fragmentary portion is shown. The surface 8A can be a table top, book, brief case of the flat type. As will be explained hereinafter it is merely necessary to provide a flat surface for supporting the sheet 8 and, furthermore, it is not necessary for the sheet to be secured to the support surface.

The aid is positioned upon the sheet 8 so that the element edges 9 and 10 are adjacent to and are able co-operate with the edge 11 of the sheet 8. Since the pencil or the like marking implement guide edges 6 and 7 are perpendicular to the direction R it follows that the edges will be perpendicular to the edge 11 when the edges 9 and 10 abut the edge 11 of the sheet 8.

By displacing the drawing aid lengthwise of the sheet edge 11 whilst ensuring the contact with the sheet edge it will be possible to draw lines or to form series of dots or dashes perpendicular to the sheet edge at any desired position lengthwise of the sheet edge 11.

Returning now to the further consideration of the Figures of the drawings a secondary extension, plate arm, ear or element 12 projects from the element 4 in the lengthwise direction of the main body. A similar secondary element 13 projects from the element 5. The element 12 includes a horizontally directed part 12A and an inclined part 12B, the latter extending at 45° to the part 12A. The element 13 has similar parts 13A and 13B.

User finger location means 14 are provided on the elements 4 and 5. These location means can comprise recesses; knurled or other roughened regions or raised parts. In the FIGS. 2 and 4 raised parts in the form of rims 15 have been shown. If desired, a third finger locating means can be provided at the neck region 2A of the main body 2. This third location means is shown in dashed lines at 14A in FIG. 1.

The thickness of the horizontal parts 12A and 13A of the elements 12 and 13 relative to the thickness of the elements 4 and 5 and also the main body 2 is such that the lower surfaces of the parts 12A and 13A are each located above the plane of the lower surface 16 of the main body 2 and the elements 4 and 5. With this arrangement a step or gap is produced of such height dimension relative to the plane of the lower surface 16 that the gap or step is able to accommodate with clearance the maximum thickness of sheet material that can satisfactorily be used with the drawing aid.

Figure 4:
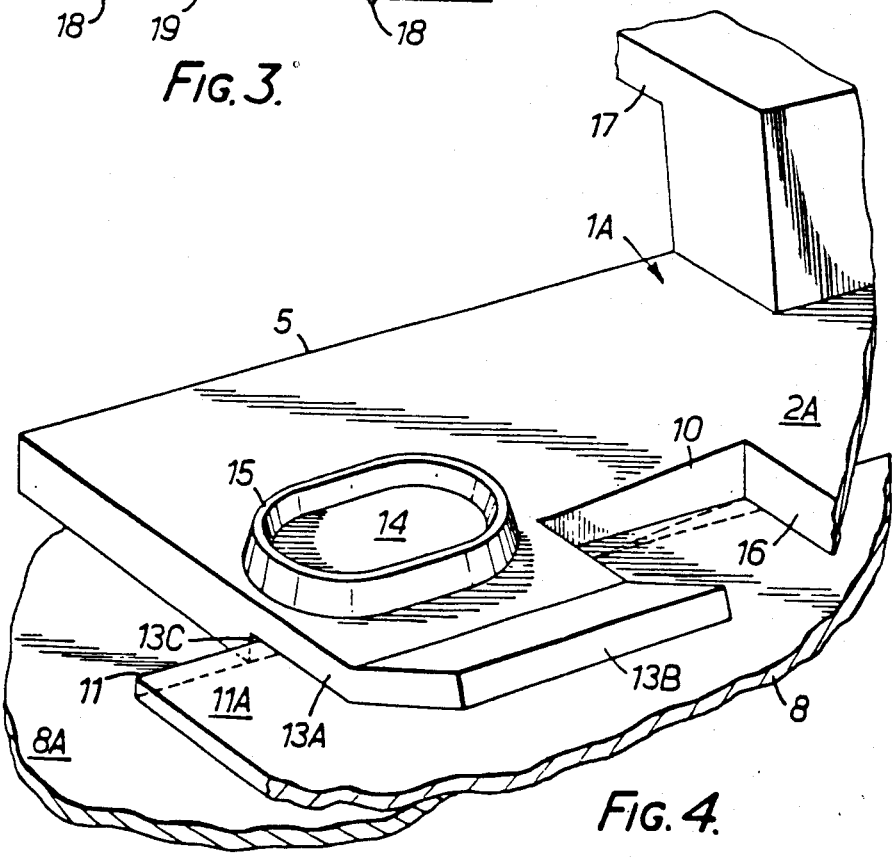
FIG. 4 is a schematic view in three dimensional form of a detail of the drawing aid of FIGS. 1, 2 and 3, the FIG. 4 illustrating the drawing aid when operationally positioned with respect to a sheet of paper of which only a fragment is shown and to a larger scale than that of FIGS. 1 to 3.

As will be seen from FIG. 4 the formation of the element 13 produces the gap or step and in so doing produces a vertical surface 13C which is effectively an extension of the face or edge 10 of the associated element 5. A similar vertical surface 12C is produced by the formation of the element 12, the surface 12C forming effectively an extension of the face or edge 9. In other words the various surfaces and faces 9,10, 12C and 13C all co-operate to provide the reference direction R.

A centrally disposed cantilever arm 17 is provided at the end of the drawing aid that is adjacent to the elements 4 and 5. The arm 17 facilitates the general lifting of the aid, by facilitating the tilting of the main body 2 away from the sheet 8.

Two series of ribs 18 directed longitudinally of the main body project from the lower surface 16 of the main body. The ribs 18 of the two series are parallel to each other. The ribs have a triangular cross section so that they present a relatively sharp contact region with the sheet.

The major part of the main body 2 is stiffened in the longitudinal direction thereof by means of an inverted channel 19 which terminates short of the line R defined by the surfaces and edges 9,10,12C and 13C, whereby a region is established in which a higher flexibility is possible at the so-called neck region 2A of the main body 2. This enables the stiffened part of the main body slightly to flex up or down relative to the remainder of the drawing aid 1 in the vicinity of the elements 4 and 5.

A graduated scale is provided along each edge 6 and 7 of the main body, the nature of the scales being as required i.e., a metric distance scale.

The general mode of use of the drawing aid 1 as so far considered will now be examined. To recapitulate it has been mentioned that in use the sheet 8 of material to be marked is laid upon a larger area support surface 8A (only a fragmentary portion of the surface 8A being shown) and the drawing aid 1 of the invention is caused to co-operate with an edge 11 of the sheet 8.

In practice, the sheet 8 is oriented with respect to the support surface 8A such that the edge 11 is located to the left hand side of the sheet and thus the user when the latter is right-handed. In the case of a left-handed user the edge 11 would be located to the right hand side of the sheet and thus the user. Also for convenience of working the edge 11 is arranged in a generally upright setting with respect to the position of the user.

The mode of aligning or registering the drawing aid 1 with respect to the edge 11 will now be examined in greater detail It will be presumed that the edge 11 has been arranged for the benefit of a right-handed user upon the support surface 8A.

The drawing aid is bodily moved by means of the cantilever arm 17 to a location closely adjacent to the sheet and such that the elements 4 and 5 are in the near vicinity of the edge 11 of the sheet 8. The user then engages the second finger and thumb of the left hand in the upstanding rims 15 and if thought useful the fore finger in the recess 14A. Also the third finger can be used to provide an additional steadying effect to the overall feel of placement situation.

The user then exerts a sufficient pressure on the elements to establish a feel which is indicative that the elements 4 and 5 have been slightly depressed. This initial depression causes the elements to present the vertical surfaces and edges 9,10,12C and 13C towards the adjacent edge 11 of the sheet, and simultaneously causes the lower surfaces of the neck region 2A and the elements 12A, 13A in co-operation with the support surface 8A to confine the marginal region 8B of the sheet 8 and thus prevent buckling, thereby ensuring that the actual edge 11 of the sheet forms a substantially rectilinear guide for the vertical surfaces and edges 9,10,12C and 13C.

Following this the user than positionally adjusts the drawing aid towards the edge until the above mentioned surfaces contact the edge 11. During this movement the user will use the right hand to restrain the sheet against displacement relative to the support surface 8A. The adjustment of the drawing aid vertical surfaces into the contact position with the edge 11 of of the sheet 8 normally involves a rocking or to and fro movement of the aid 1 relative to the edge 11. It will be noted that during the above mentioned stages of positional adjustment of the drawing aid to the edge 11 the parts 12B and 13B of the elements assist in guiding the elements 12 and 13 over the edge 11 and prevent the elements from entering beneath the sheet.

Upon achieving the contact with the edge 11 the elements 4 and 5 are further depressed until the lower surfaces thereof abut the support surface 8A. It will be noted from the FIG. 4 that with the elements 4 and 5 fully pressed into contact with the support surface 8A a clamping effect is produced across the width of the main body in the vicinity of the root ends of the elements 4 and 5, that is to say, the neck region 2A. In addition, the flexibility of the main body neck region 2A between the reference line R and the adjacent end of the stiffening channel 19 will accommodate any tendancy for the main body to tilt or lift away from the sheet.

At this stage it will be found readily possible to move the drawing aid lengthwise of the sheet 8 using the edge 11 as a guide, by slightly releasing the firm pressure upon the elements 4 and 5. The clamping action between the surface 16 and the support 8A is maintained by the resilience of the elements 4 and 5 and the neck 2A. During displacement of the drawing aid lengthwise of the edge 11 it will be found necessary for the user to restrain the sheet 8 against displacement relative to the surface 8A by engaging the sheet with the right hand.

It has been found that the sheet tends to rotate about the user's right hand, due to the aid being pressed against the edge 11 with a force not aligned with the fulcrum formed by the right hand, such rotation making difficult precise positioning of the aid. The clamping action described substantially reduces the tendancy of the sheet to rotate, so that moderate pressure by the user's right hand is sufficient to immobilise the sheet B.

On reaching the required position the elements 4 and 5 are pressed firmly into contact with the support surface 8A. It has been found that once the firm clamping action is effected by the pressure upon the elements 4 and 5 against the support 8A the sheet is also firmly held in place so that it is no longer necessary for the user to engage the sheet with the right hand whereby marking of the sheet can be effected without relative displacement occuring between the drawing aid 1, the sheet 8 and support 8A. In addition, the forefinger may be pressed on the location 14A (FIG. 1), which action tends to prevent any change in the alignment during a marking operation, by holding the surfaces and edges 9,10,12 C and 13C in contact with edge 11.

The above mentioned step may be extended across the full width of the neck region In this case the depth of the step between edges 9 and 19 is less than the thickness of the material to be used with the aid as the step is only intended to engage only with the upper regions of the material edge 11.

Furthermore, as a result of the height dimension of the gap or slot the parts 12A and 13A do not contact the surface of the sheet This factor in conjunction with the flexibility of the elements 4 and 5 makes it possible for the drawing aid to be used with sheet material of differing thicknesses.

The basic constraint in this respect is that the engagement of the elements 4 and 5 with the support surface 8A must not be prevented by the engagement of the parts 12A and 13A with the surface of the sheet 8.

It should also be noted that the flexibility of the elements 4 and 5 makes it possible for the drawing aid to conform to a support surface which is not accurately flat.

Since the drawing aid of the invention is intended for use with single sheets of paper commonly available such as typing top copy paper, typing copy paper or similar papers having thicknesses of the order of 0.0033 inches (0.084 mm) such sheets will clearly be highly flexible or non-rigid and easily distortable at the edge regions thereof whereby any irregularity of the support suface 8A of the order of sixty microns would, if the elements 4 and 5 were non-flexible prevent the elements from co-operating with the edge 11 of a sheet at a location where an irregularity deeper than the sixty microns occured. By providing the flexible elements 4 and 5 such difficulties arising from a non-flat support surface 8A do not arise.

The previously mentioned series of ribs 18 serve a useful function during the setting or registration of the drawing aid relative to the sheet edge. As has been mentioned during the setting of the aid relative to the edge 11, the user by means of his left hand swings the aid slightly with a to and fro movement. In the absence of the ribs 18 this motion will involve moving the total surface area of the main body 2 relative to the sheet surface which would then be in overall contact with the main body. Because of such overall contact considerable frictional force would need to be overcome in order to achieve the requisite swinging action. In addition, the ensuing rubbing contact could induce electrostatic attraction between the main body lower surface and the sheet surface thereby increasing the resistance to the required movements. This in turn, causes the user to increase the force exerted to achieve the required setting or registration movements and thus impedes a smooth movement for the adjustments.

The provision of the ribs 18 not only reduces the excessive resistance to movement difficulties mentioned above but also tends to reduce any tendancy for the drawing aid to shift during use. This is thought to result from the increased loca pressures which occur between the ribs and the surface of the sheet 11 as compared with the overall pressure spread over the whole area of the main body.

Figure 5:
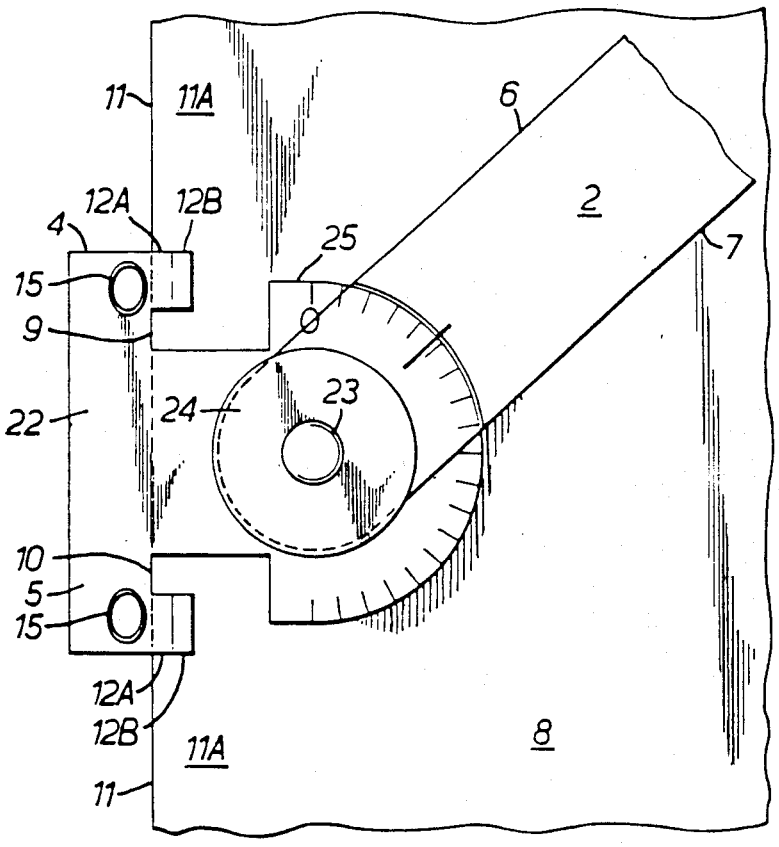
FIG. 5 is a diagrammatic plan view of a part of a second embodiment of a drawing aid in which the angle at which lines may be drawn is selectively variable.
Figure 6:
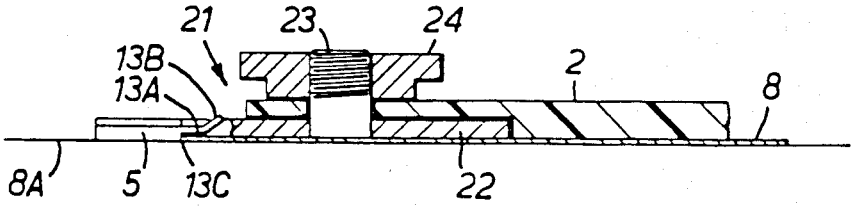
FIG. 6 is a diagrammatic cross section of the drawing aid of FIG. 5.

Referring now to FIGS. 5 and 6 these Figures illustrate a construction in which a protractor assembly 21 is provided. In this construction the main body is effectively pivotally connected to a stub main body part 22 having the elements 4 and 5 together with the elements 12 and 13 at one end thereof. The stub body part mounts a screwed member 23 onto which the main body is connected by a pivotal connection. An operating head 24 is provided for locking the main body in a desired setting. The stub main body part 22 is provided with a protractor whose calibration is such that the 90° mark lies on a line which is perpendicular to the reference line R defined by the edges 9 and 10 of the elements 4 and 5.

In use of the construction of FIGS. 5 and 6 the drawing aid will be positionally set as discussed in relation to the embodiment of FIGS. 1 to 4. In addition, the angle made by the main body edge 6 and 7 may be set as required.

It should be noted that in the FIG. 6 a support surface 8A is indicated.

The section of the aid 1 to the left of the line R that is the reference surfaces and edges 9,10,12C and 13C and part of the neck region 2A can be conveniently regarded as a location region 1A, the latter including the elements 4 and 5.

Figure 7:
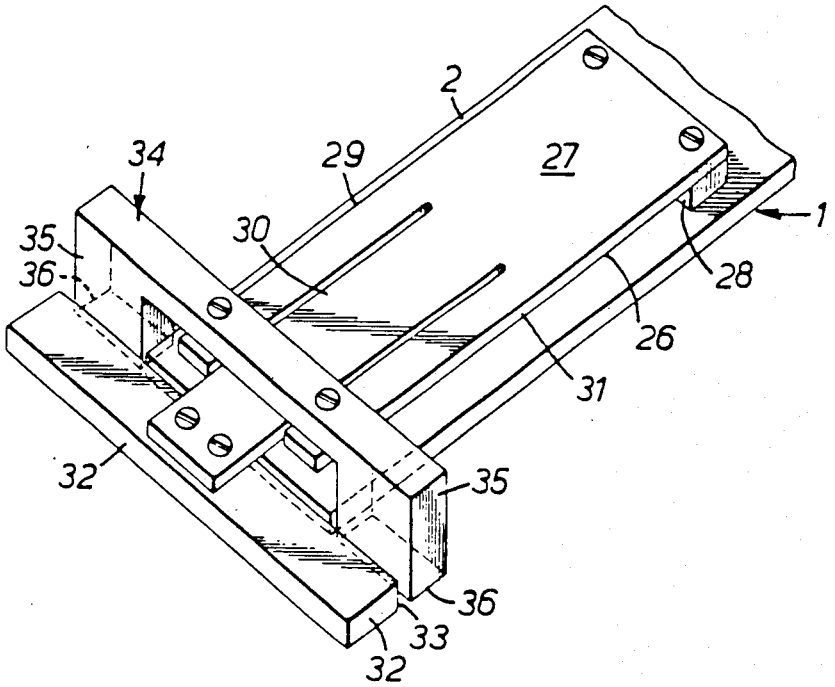
FIG. 7 is a diagrammatic three dimensional view of a part of a further embodiment of a drawing aid

A further embodiment of the invention is shown in FIG. 7. In this embodiment the flexible element arrangements have been replaced by a bracket arrangement 26 which is mounted to the main body 2 of the drawing aid 1.

The bracket assembly 26 includes a plate 27 connected to the main body 2 by way of a transverse mounting block 28. The other end of this plate is divided into three side-by-side strips 29, 30 and 31, which, in practice, produce a resilient cantilever effect.

The inner one of the strips 30 is longer than the two outer strips 29 and 31 and is connected at its free end to a transverse block 32 having an inner vertical face 33. An inverted U-shaped bridge member 34 is connected to the two outer strips 29 and 31. The bridge member 34 bridges the main body 2 and includes two leg parts 35 which are generally in line with the end region of the inner end of the main body and which have bottom faces 36 that lie in a common plane.

In the FIG. 7 fragmentary portions of the sheet 8 and the support surface 8A are shown so that the relationship of the aid 1, when in use, to the sheet edge 11 and the surface may be seen.

In use the aid is placed in co-operation with the sheet so that the body can lie on the sheet with the block 34 located above the marginal edge region 11A of the sheet and with the inner vertical face 33 of the block adjacent to the sheet edge 11.

The block 32 is depressed towards the surface 8A until a satisfactory feel is obtained between the vertical face 33 and the sheet edge 11. In view of the structure of the bracket arrangement 26 the downward movement of the block 32 will automatically pull the bridge member 34 downwards into contact with the marginal region 11A of the sheet 8.

The aid is the positionally adjusted as above described with respect to the sheet to obtain the desired positional setting. Once this setting is obtained the block is pressed firmly into contact with the support surface 8A. This operation will automatically pull the bridge member 34 into a firmer contact with the sheet marginal edge 11A.

If desired the user can exert additional pressure upon the bridge member 34 by pressing thereupon with a convenient finger.

Figure 8:
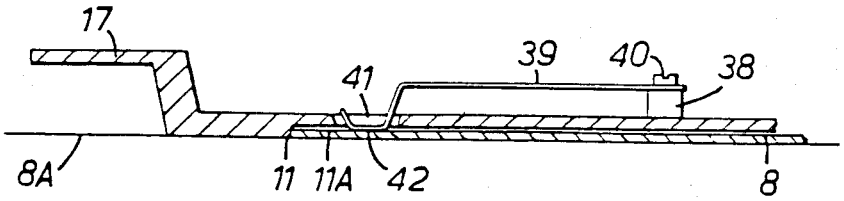
FIG. 8 is a fragmentary sectional view on the line IX—IX of a further embodiment of a drawing aid shown in FIG. 9.
Figure 9:
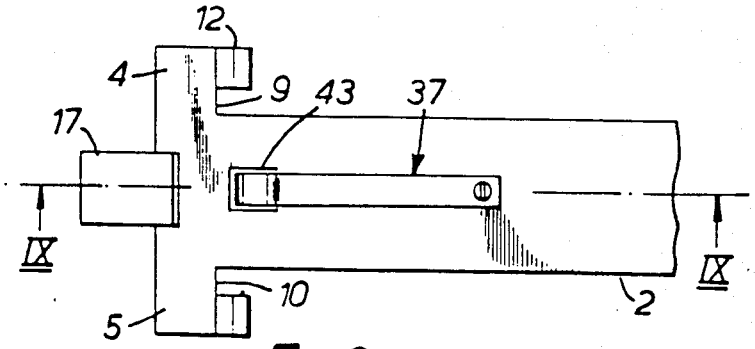
FIG. 9 is a fragmentary plan view of the further embodiment of the drawing aid.

Referring now to FIGS. 8 and 9 in this embodiment of the aid a leaf spring arrangement 37 is provided for exerting pressure upon the marginal edge region 11A of the main body 2 in addition to those arising from the pressure exerted upon the elements 4 and 5 in the manner considered above. The leaf spring arrangement includes a post 38 upstanding from the main body. A spring member 39 is mounted cantilever fashion to the post and is secured thereto by a screw 40. The free end region 41 of the spring member 39 is deformed to provide a sheet engaging part 42 which projects through a bore 43 provided in the main body 2. As will be noted the initial set or positioning of the spring member 39 is such that the part 42 protrudes slightly below the plane of the lower surface 16 of the main body.

The extent of the protrusion of the part 42 is such that the spring member 39 is able to exert a pressure on the marginal edge region 11A during the setting adjustments of the aid.

The step which is formed by the elements 12 and 13 can be continued across the full width of the underside of the drawing aid, as indicated at the dashed line 44 in FIG. 9. The depth of the step 44 is less than the thickness of the sheet material to be used with the aid as the step extension is intended to engage only with the upper regions of the sheet edge 11.

The aid is conveniently made from a transparent plastics material.

In a variation of the construction of FIGS. 8 and 9 the leaf spring arrangement could be replaced or augmented by a press type of spring assembly (not shown) which is depressible to exert pressure upon the sheet when it is required to prevent relative displacement between the aid and sheet and the sheet and surface.

I claim:

1. A drawing aid for facilitating the drawing of lines or other mixtures upon a sheet of material having at least one sheet edge with each such edge having a marginal sheet edge region associated therewith and lying upon a support surface, the sheet material being of such thickness that the sheet is flexible or nonrigid, the aid comprising; an elongate blade-like portion; at least one guide edge for sheet marking means, the guide edge extending lengthwise of the elongate blade-like portion for guiding the sheet marking means along a direction defined by the guide edge; and resilient means so deformable relative to the elongate blade-like portion as to be engageable with a said sheet edge of the sheet upon which the elongate blade-like portion is placed, such that said sheet edge provides a direction guide for positioning the drawing aid during use with respect to the sheet.

2. A drawing aid as claimed in claim 1, and in which the resilient means comprises on each side of the elongate blade-like portion means defining reference faces or edges, each face or edge adapted to engage with said sheet edge.

3. A drawing aid as claimed in claim 1, and in which the resilient means includes a pair of arms extending transversely of the elongate blade-like portion with each such arm defining a reference face for engagement with said sheet edge on deformation of the associated arm towards the support surface following engagement of the elongate blade-like portion with the sheet.

4. A drawing aid as claimed in claim 3, and in which each said arm is provided with an extension extending lengthwise of the elongate blade-like portion, and located at such position relative to the associated arm as to overlie the marginal edge region associated with the edge that is engaged during engagement of the reference faces with the edge of the sheet.

5. A drawing aid as claimed in claim 4, and in which each said extension defines surfaces for co-operation with the marginal edge region of the sheet associated with said sheet edge on deformation of the associated arm towards the support surface.

6. A drawing aid as claimed in claim 1, and comprising means for indicating preferred positions for the user's fingertips on the resilient means when using the drawing aid.

7. A drawing aid as claimed in claim 1, and in which said resilient means is able to exert pressure upon the marginal edge region of the sheet that is adjacent to said edge when the aid is cooperating with the sheet and is being urged into cooperation with the support surface.

8. A drawing aid as claimed in claim 7, and in which the resilient means includes a leaf spring arrangement having a part adapted to co-operate with a said sheet marginal edge region on engaging the aid with the sheet.

9. A drawing aid as claimed in claim 1, and in which said resilient means is formed integrally with the elongate blade-like portion.

10. A drawing aid as claimed in claim 1, and in which the elongate blade-like portion is formed separately from the resilient means whereby the guide edge can be selectively set with respect to the resilient means so as to enable selective variation of the direction of the guide edge relative to said sheet edge.

11. A drawing aid as claimed in claim 1, and in which the elongate blade-like portion is provided with stiffening means extending lengthwise of the blade-like portion.

12. A drawing aid as claimed in claim 1, and in which the resilient means comprises a cantilever arrangement incorporating first means defining a reference face or edge adapted for engagement with a said sheet edge and a second face adapted to engage with the support surface when the drawing aid is rested upon said sheet lying on the support surface, said cantilever arrangement also incorporating second means adapted automatically to engage with the marginal edge region of the sheet adjacent to said sheet edge after said second face has been caused to engage with the support surface.

* * * * *

UNITED STATES PATENT AND TRADEMARK OFFICE

CERTIFICATE OF CORRECTION

PATENT NO. : 4,669,197

DATED : June 2, 1987

INVENTOR(S) : David C. L. Griew

It is certified that error appears in the above-identified patent and that said Letters Patent is hereby corrected as shown below:

In claim 1, line 2, replace "mixtures" with --markings--.

Signed and Sealed this

Twentieth Day of October, 1987

*Attest:*

DONALD J. QUIGG

*Attesting Officer*

*Commissioner of Patents and Trademarks*